US006122844A

United States Patent [19]

Nunez

[11] Patent Number: 6,122,844

[45] Date of Patent: Sep. 26, 2000

[54] DRESS SHOE WITH CUSHIONED BLADDER

[76] Inventor: Luis Alberto Nunez, P.O. Box 89-3011, Birri, Barva, Heredia 3011, Costa Rica

[21] Appl. No.: 09/090,181

[22] Filed: Jun. 4, 1998

[51] Int. Cl.[7] ..... A43B 13/20

[52] U.S. Cl. ..... 36/29; 36/35 B

[58] Field of Search ..... 36/28, 29, 35 B, 36/35 R, 37

[56] References Cited

U.S. PATENT DOCUMENTS

| | | |
|---|---|---|
| 541,814 | 6/1895 | King . |
| 812,496 | 2/1906 | Irwin . |
| 925,354 | 6/1909 | Lambert . |
| 1,328,154 | 1/1920 | Jackerson . |
| 1,766,311 | 6/1930 | Shaft . |
| 1,819,565 | 8/1931 | McBride . |
| 2,303,744 | 12/1942 | Jacobs . |
| 2,532,742 | 12/1950 | Stoiner . |
| 4,783,910 | 11/1988 | Boys, II et al. . |
| 4,912,861 | 4/1990 | Huang . |

FOREIGN PATENT DOCUMENTS 21594 of 1903 United Kingdom .

*Primary Examiner*—Ted Kavanaugh

[57] ABSTRACT

A padded dress shoe is provided including a sole having a generally rigid heel portion defining an open top. The sole has an upper mounted thereon for forming an interior space in which a foot may be inserted. Further included is a flexible, thin planar shoe pad having a periphery with a size and shape similar to that of the sole. The shoe pad is situated on the sole within the shoe, thereby affording a closed compartment within the heel portion of the sole. A closed, impermeable cushioned bladder is situated within the compartment of the heel portion.

6 Claims, 2 Drawing Sheets

DRESS SHOE WITH CUSHIONED BLADDER

BACKGROUND OF THE INVENTION

1. Field of the Invention

The present invention relates to cushioned soles and more particularly pertains to a new dress shoe with cushioned bladder for cushioning the sole of a dress shoe.

2. Description of the Prior Art

The use of cushioned soles is known in the prior art. More specifically, cushioned soles heretofore devised and utilized are known to consist basically of familiar, expected and obvious structural configurations, notwithstanding the myriad of designs encompassed by the crowded prior art which have been developed for the fulfillment of countless objectives and requirements.

Known prior art cushioned soles include U.S. Pat. No. 5,317,717; U.S. Pat. No. 4,567,677; U.S. Pat. No. 5,152,081; U.S. Pat. No. 3,087,261; U.S. Pat. No. 1,193,608; and Foreign Patents WO 92/21257 and EP 0 516 874 A1.

In these respects, the dress shoe with cushioned bladder according to the present invention substantially departs from the conventional concepts and designs of the prior art, and in so doing provides an apparatus primarily developed for the purpose of cushioning the sole of a dress shoe.

SUMMARY OF THE INVENTION

In view of the foregoing disadvantages inherent in the known types of cushioned soles now present in the prior art, the present invention provides a new dress shoe with cushioned bladder construction wherein the same can be utilized for cushioning the sole of a dress shoe.

The general purpose of the present invention, which will be described subsequently in greater detail, is to provide a new dress shoe with cushioned bladder apparatus and method which has many of the advantages of the cushioned shoe soles mentioned heretofore and many novel features that result in a new dress shoe with cushioned bladder which is not anticipated, rendered obvious, suggested, or even implied by any of the prior art cushioned shoe soles, either alone or in any combination thereof.

To attain this, the present invention generally comprises a sole with a rigid heel portion including a closed planar bottom face. As shown in FIG. 1, a peripheral side wall is integrally coupled to a periphery of the bottom face and extends upwardly therefrom to define a hollow interior space and an open top. The side wall is defined by a pair of linear side faces, a convex rear face and a concave front face. It should be noted that the sole has an upper connected to a periphery thereof for defining an interior space in which a foot may be inserted. Next provided is a flexible, thin planar shoe pad having a periphery with a size and shape similar to that of the sole. The shoe pad is removably situated on the sole within the shoe. This affords a closed compartment within the heel portion of the sole. It should be understood that the shoe pad defines a flexible top face of the closed compartment. Lastly, a closed, impermeable cushioned bladder is provided. Preferably, the cushioned bladder is constructed from flexible silicon. Further, the cushioned bladder is filled with a viscous oil, air, or water. Ideally, a volume equal of the cushioned bladder and its contents amount to that of the heel portion. In use, the cushioned bladder is situated within the compartment of the heel portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new dress shoe with cushioned bladder apparatus and method which has many of the advantages of the cushioned shoe soles mentioned heretofore and many novel features that result in a new dress shoe with cushioned bladder which is not anticipated, rendered obvious, suggested, or even implied by any of the prior art cushioned shoe soles, either alone or in any combination thereof.

It is another object of the present invention to provide a new dress shoe with cushioned bladder which may be easily and efficiently manufactured and marketed.

It is a further object of the present invention to provide a new dress shoe with cushioned bladder which is of a durable and reliable construction.

An even further object of the present invention is to provide a new dress shoe with cushioned bladder which is susceptible of a low cost of manufacture with regard to both materials and labor, and which accordingly is then susceptible of low prices of sale to the consuming public, thereby making such dress shoe with cushioned bladder economically available to the buying public.

Still yet another object of the present invention is to provide a new dress shoe with cushioned bladder which provides in the apparatuses and methods of the prior art some of the advantages thereof, while simultaneously overcoming some of the disadvantages normally associated therewith.

Still another object of the present invention is to provide a new dress shoe with cushioned bladder for cushioning the sole of a dress shoe.

Even still another object of the present invention is to provide a new dress shoe that includes a sole having a generally rigid heel portion defining an open top. The sole has an upper mounted thereon for forming an interior space in which a foot may be inserted. Further included is a flexible, thin planar shoe pad having a periphery with a size and shape similar to that of the sole. The shoe pad is situated on the sole within the shoe, thereby affording a closed compartment within the heel portion of the sole. A closed, impermeable cushioned bladder is situated within the compartment of the heel portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
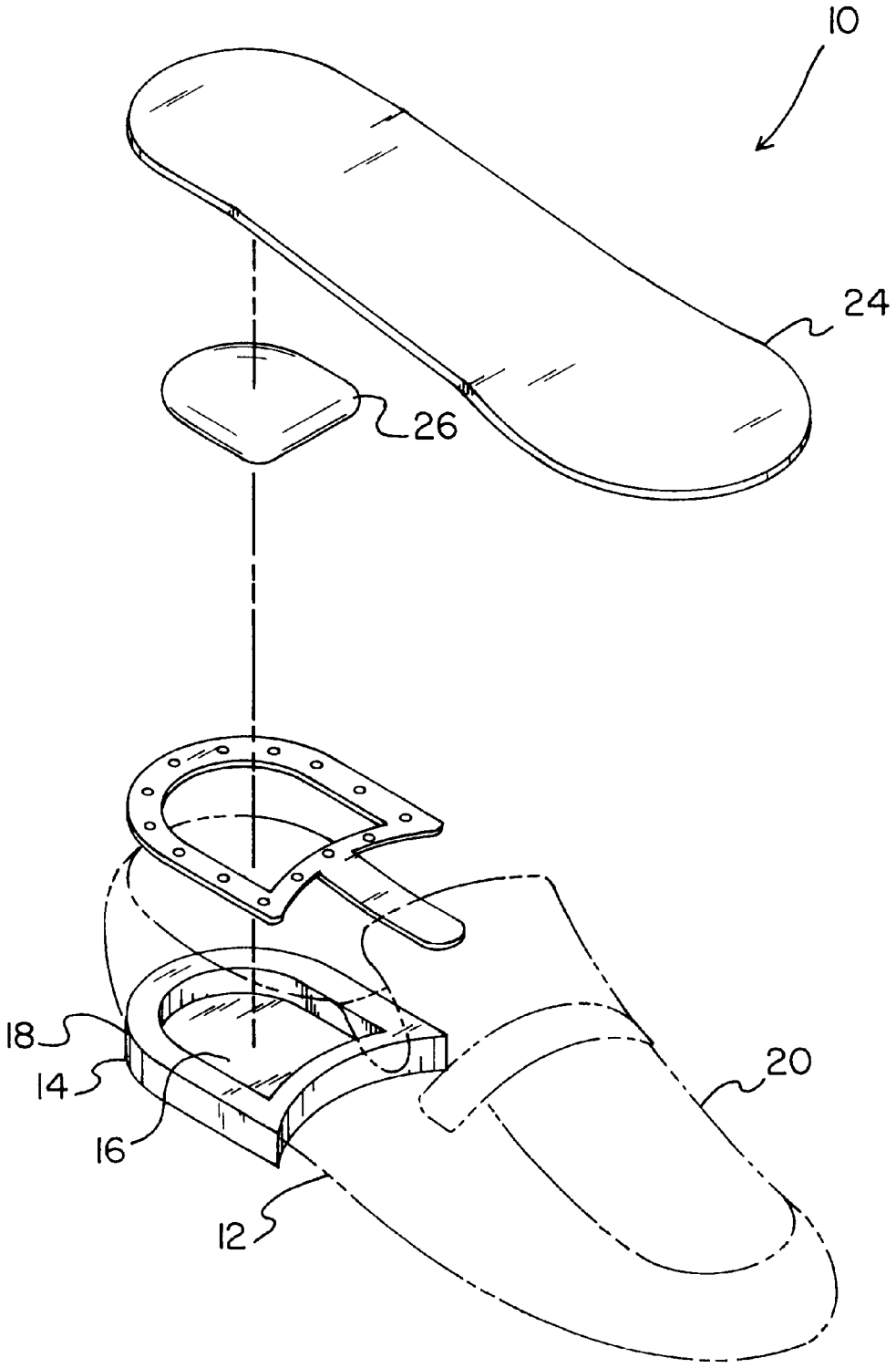
FIG. 1 is a perspective view of a new dress shoe with cushioned bladder according to the present invention.
Figure 2:
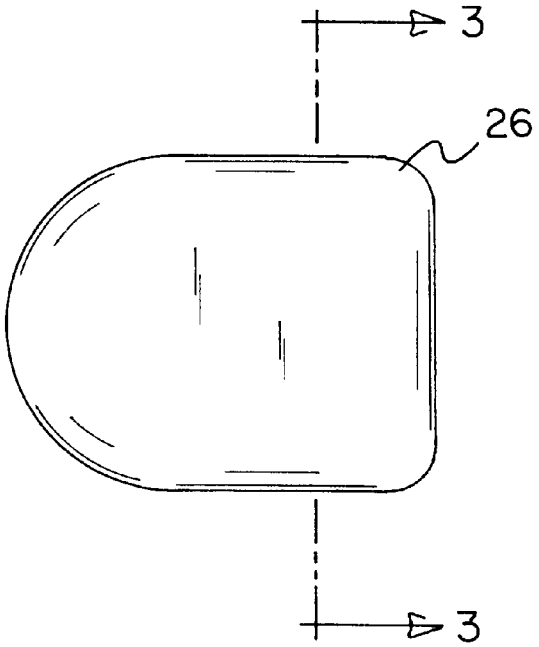
FIG. 2 is a top view of the present invention.
Figure 3:
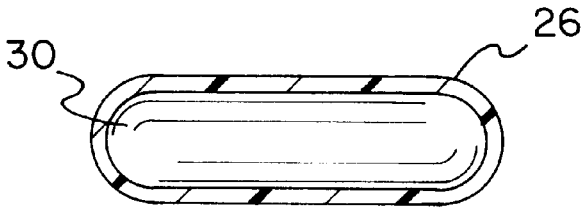
FIG. 3 is a side cross-sectional view of the present invention taken along line 3—3 shown in FIG. 2.
Figure 4:
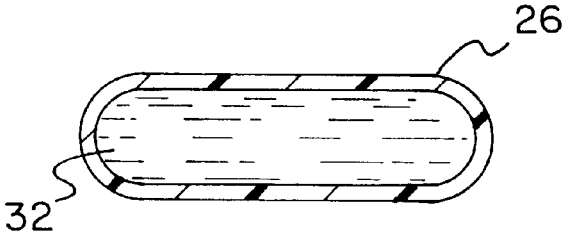
FIG. 4 is a side cross-sectional view of the cushioned bladder of an alternate embodiment of the present invention.
Figure 5:
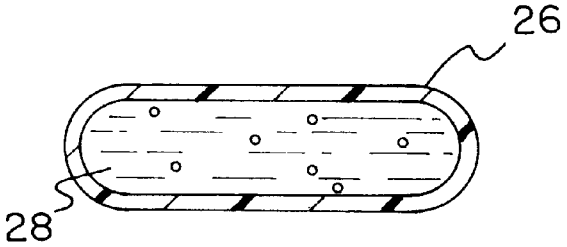
FIG. 5 is a side cross-sectional view of the cushioned bladder of yet another alternate embodiment of the present invention.

With reference now to the drawings, and in particular to FIGS. 1 through 5 thereof, a new dress shoe with cushioned bladder embodying the principles and concepts of the present invention and generally designated by the reference numeral 10 will be described.

The present invention, designated as numeral 10, includes a sole 12 having a rigid heel portion 14 constructed from a dense rubber and including a closed planar bottom face 16. As shown in FIG. 1, a peripheral side wall 18 is integrally coupled to a periphery of the bottom face and extends upwardly therefrom to define a hollow interior space and an open top. The side wall is defined by a pair of linear side faces, a convex rear face and a concave front face. It should be noted that the sole has an upper 20 connected to a periphery thereof for defining an interior space in which a foot may be inserted.

Next provided is a flexible, thin planar shoe pad 24 having a periphery with a size and shape similar to that of the sole. The shoe pad is removably situated on the sole within the shoe. This affords a closed compartment within the heel portion of the sole. It should be understood that the shoe pad defines a flexible top face of the closed compartment.

Lastly, a closed, impermeable cushioned bladder 26 is provided. Preferably, the cushioned bladder is constructed from flexible silicon. Further, the cushioned bladder is filled with a viscous oil 28, air 30, or water 32. Ideally, a volume equal of the cushioned bladder and its contents amount to that of the heel portion. Further, a periphery of the cushioned bladder is preferably defined by a pair of linear side edges, an arcuate rear edge and a linear front edge for conforming to the side wall of the heel portion of the sole. As an option, a shoe last may be incorporated with the present invention. Note FIG. 1.

In use, the cushioned bladder is situated within the compartment of the heel portion. By this structure, comfort is afforded to a wearer of the dress shoe. In an alternate embodiment, an electric air pump is preferably attached to the dress shoe for circulating air therein. Such air pump may be mounted either to the upper or the sole of the shoe. Further, the air pump may be adapted to work in conjunction with a heater or cooling mechanism.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A padded dress shoe comprising:

a sole including a generally rigid heel portion defining an open top, the sole having an upper mounted thereon for forming an interior space in which a foot may be inserted;

a flexible, thin planar shoe pad situated on the sole within the shoe, thereby affording a closed compartment within the heel portion of the sole with a flexible top face;

an open generally D-shaped intermediate sole having an inner periphery defining a generally D-shaped central space, the intermediate sole being interposed between the heel portion and the shoe pad;

the intermediate sole having upper and lower faces, the lower face of the intermediate sole facing downwards towards the heel portion and the upper face of the intermediate sole facing upwards towards the shoe pad;

the intermediate sole comprising an generally U-shaped rear portion and an arcuate front portion, the rear portion having a pair of ends, the front portion extending between the ends of the rear portion, the front portion having an outwardly facing concavity facing towards a toe end of interior space;

the intermediate sole being positioned around an outer periphery of the compartment of the heel portion such that the open top heel portion is exposed through the central space of the intermediate sole;

the intermediate sole having a plurality of generally circular holes arranged in a row extending around the inner periphery of the intermediate sole, the holes being spaced apart at generally equal intervals in the row of holes, the holes of the intermediate sole being adapted for extending fasteners therethrough to secure the intermediate sole to the heel portion;

the intermediate sole having an elongate tongue forwardly extending from the front portion of the intermediate sole, the tongue of the intermediate sole being positioned beneath the shoe pad and being adapted for helping hold the intermediate sole in position between the heel portion and the shoe pad; and a closed, impermeable cushioned bladder situated within the compartment of the heel portion.

2. A padded dress shoe as set forth in claim 1 wherein the bladder is filled with air.

3. A padded dress shoe as set forth in claim 1 wherein the bladder is filled with oil.

4. A padded dress shoe as set forth in claim 1 wherein the bladder is filled with water.

5. A padded dress shoe as set forth in claim 1 wherein the heel portion of the sole includes a closed bottom face and a peripheral side wall.

6. A padded dress shoe comprising, in combination:

a sole including a rigid heel portion defined by a closed planar bottom face and a peripheral side wall integrally coupled to a periphery of the bottom face and extending upwardly therefrom to define a hollow interior space and an open top, the side wall defined by a pair of linear side faces, a convex rear face and a concave front face, the sole having an upper connected to a periphery thereof for defining an interior space in which a foot may be inserted;

the sole having an arch portion adjacent to and in front of the concave front face of the heel portion;

a flexible, thin planar shoe pad having a periphery with a size and shape similar to that of the sole, the shoe pad being removably situated on the sole within the shoe, thereby affording a closed compartment within the heel portion of the sole with a flexible top face;

an open generally D-shaped intermediate sole having an outer periphery and an inner periphery defining a generally D-shaped central space, the intermediate sole being interposed between the heel portion and the shoe pad;

the intermediate sole having upper and lower faces, the lower face of the intermediate sole facing downwards towards the heel portion and the upper face of the intermediate sole facing upwards towards the shoe pad;

the intermediate sole comprising an generally U-shaped rear portion and an arcuate front portion, the rear portion having a pair of ends, the front portion extending between the ends of the rear portion, the front portion having an outwardly facing concavity facing towards a toe end of interior space;

the front and rear portions of the intermediate sole each having a width defined between corresponding adjacent portions of the inner and outer peripheries of the intermediate sole, wherein the width of the rear portion of the intermediate sole is greater than the width of the front portion of the intermediate portion of the sole;

the intermediate sole being positioned around an outer periphery of the compartment of the heel portion such that the open top of the compartment is exposed through the central space of the intermediate sole;

the portion of the outer periphery of the intermediate sole adjacent the front portion of the intermediate sole being positioned adjacently along the concave front face of the heel portion;

the concave front face of the heel portion and the portion of the outer periphery of the intermediate sole adjacent the front portion of the intermediate sole having substantially equal radii of curvatures such that the concave front face of the heel portion and the portion of the outer periphery of the intermediate sole adjacent the front portion of the intermediate sole define substantially equal sized arcs;

the intermediate sole having a plurality of generally circular holes arranged in a row extending around the inner periphery of the intermediate sole, the holes being spaced apart at generally equal intervals in the row of holes, the hole of the intermediate sole being adapted for extending fasteners therethrough to secure the intermediate sole to the heel portion;

the intermediate sole having an elongate tongue forwardly extending from the front portion of the intermediate sole, the tongue of the intermediate sole being positioned beneath the shoe pad and being extended over the arch portion of the sole, the tongue of the intermediate sole being adapted for helping hold the intermediate sole in position between sole and the shoe pad; and a closed, impermeable cushioned bladder constructed from flexible silicon, the cushioned bladder being filled with a viscous oil and having a volume equal to that of the heel portion, wherein the cushioned bladder is situated within the compartment of the heel portion.

* * * * *